US007676869B2

(12) United States Patent
Zelnik et al.

(10) Patent No.: US 7,676,869 B2
(45) Date of Patent: Mar. 16, 2010

(54) APPARATUS FOR SUPPORTING A PATIENT IN A PRONE POSITION DURING DIAGNOSTIC IMAGING

(75) Inventors: Deborah Ruth Zelnik, Haifa (IL); Yaron Hefetz, Herzeliya (IL)

(73) Assignee: GE Healthcare Israel, Tirat Hacarmel (IL)

( * ) Notice: Subject to any disclaimer, the term of this patent is extended or adjusted under 35 U.S.C. 154(b) by 620 days.

(21) Appl. No.: 11/580,551

(22) Filed: Oct. 13, 2006

(65) Prior Publication Data

US 2008/0005841 A1 Jan. 10, 2008

Related U.S. Application Data

(63) Continuation-in-part of application No. 11/481,627, filed on Jul. 6, 2006, now Pat. No. 7,603,730.

(51) Int. Cl.

| | |
|---|---|
| ***A61G 13/12*** | (2006.01) |
| ***A47C 16/00*** | (2006.01) |
| ***A47C 20/00*** | (2006.01) |
| ***A61B 6/04*** | (2006.01) |

(52) U.S. Cl. ..... 5/632; 5/621; 5/622; 5/623; 5/601; 378/208

(58) Field of Classification Search ..... 5/601, 5/600, 621–623, 632, 638, 643, 646, 661, 5/655.9, 953; 378/208, 209, 20
See application file for complete search history.

(56) References Cited

U.S. PATENT DOCUMENTS

| | | | | |
|---|---|---|---|---|
| 3,608,103 | A * | 9/1971 | Seid | 5/661 |
| 4,074,374 | A * | 2/1978 | Ayesh | 5/400 |
| 4,779,297 | A * | 10/1988 | Sturges | 5/630 |
| 5,347,668 | A * | 9/1994 | Manning | 5/622 |
| 5,466,039 | A * | 11/1995 | Umbrianna | 297/116 |
| 5,661,860 | A * | 9/1997 | Heitz | 5/632 |
| 5,675,851 | A * | 10/1997 | Feathers | 5/632 |
| 5,678,266 | A * | 10/1997 | Petringa et al. | 5/655.5 |
| 5,970,546 | A * | 10/1999 | Danis | 5/636 |
| 6,148,460 | A * | 11/2000 | Fried et al. | 5/661 |
| 6,151,734 | A * | 11/2000 | Lawrie | 5/640 |
| 6,718,581 | B2 * | 4/2004 | Riach | 5/632 |
| 6,813,788 | B2 * | 11/2004 | Dinkler et al. | 5/622 |
| 6,928,679 | B1 * | 8/2005 | Gross | 5/638 |

(Continued)

OTHER PUBLICATIONS

EarthGear™ therapeutic innovations, Pinnacle, www.earthgear.com, 1 pg.

(Continued)

*Primary Examiner*—Robert G Santos
(74) *Attorney, Agent, or Firm*—Dean D. Small; Small Patent Law Group

(57) ABSTRACT

A patient positioning apparatus to support a patient in a prone position on a patient table during a diagnostic imaging scan comprises a head support and an arm support. The head support is configured to extend beyond an end of a patient table and to support a patient's head relative to a table top of the patient table while the patient lies on the patient table in a prone position. The arm support is joined to the head support and is configured to extend below the patient table to support a patient's forearms below the patient table.

18 Claims, 9 Drawing Sheets

U.S. PATENT DOCUMENTS

| | | | | |
|---|---|---|---|---|
| 7,089,613 | B2 * | 8/2006 | Cohen | 5/622 |
| 7,603,730 | B2 * | 10/2009 | Zelnik | 5/601 |
| 2002/0184706 | A1 * | 12/2002 | Riach | 5/632 |
| 2007/0053502 | A1 * | 3/2007 | Zelnik et al. | 378/204 |
| 2008/0005840 | A1 * | 1/2008 | Zelnik | 5/601 |
| 2008/0005841 | A1 * | 1/2008 | Zelnik et al. | 5/601 |

OTHER PUBLICATIONS

Sinmed Radiotherapy products, Sinmed Poly-ethylene cushions, www.sinmed.nl, copyright 2003, 1 pg.
Siemens medical, e.cam Signature Series Manual, 8 pgs.
Cfi Medical Solutions contour fabricators, inc. Manual, 45 pgs.
Oakworks® Medical Equipment, www.oakworksmed.com, 4pgs.
Banner Therapy Products, "Prone Pillow Pad", www.bannertherapy.com, 2 pgs.
Banner Therapy Products, "Prone Pillow by Chatt", www.bannertherapy.com, 2 pgs.
Banner Therapy Products, "Prone Pillow—MaxRelax", www.bannertherapy.com, 2 pgs.
Sinmed Radiotherapy products, "Posirest", www.sinmed.nl, 2 pgs.
Nuclear Medicin Instruments & Accessories, Catalog 28, Pinestar Technology, Inc., 134 pgs.

* cited by examiner

APPARATUS FOR SUPPORTING A PATIENT IN A PRONE POSITION DURING DIAGNOSTIC IMAGING

CROSS REFERENCE TO RELATED APPLICATIONS

The application is a continuation-in-part and claims benefit of patent application Ser. No. 11/481,627, titled "Apparatus for Supporting a Patient in a Prone position During Diagnostic Imaging", filed Jul. 6, 2006 now U.S. Pat. No. 7,603,730, the complete subject matter of which is expressly hereby incorporated herein in its entirety.

BACKGROUND OF THE INVENTION

This invention relates generally to apparatus for positioning a patient during a medical imaging procedure, and more particularly, to apparatus for positioning a patient in a prone position during a medical imaging procedure.

Diagnostic images of a patient are acquired using one or more modalities, such as Nuclear Medicine (NM), Computed Tomography (CT), Magnetic Resonance (MR), Positron Emission Tomography (PET), X-ray and Ultrasound. Some procedures for imaging anatomy, particularly within the torso, require the patient to lie prone on a patient table for a length of time without moving. In some cases, for example during nuclear imaging, an examination may last for an extended duration and thus patient comfort is advantageous. In other cases, such as during nuclear imaging, patient motion may cause image artifacts, degrade image quality or necessitate repeating the data acquisition.

The patient table is often narrow to allow the imaging detector(s) to move close to the patient, such as in NM, or to move into a small bore, such as with PET and CT. When lying on the patient table in the prone position, the patient's arms are placed up and away from the body to avoid interference with the motion of the detectors around the patient's torso (in NM) and to avoid placement between the imaging detector(s) and the anatomy of interest. For example, the patient may place their head on their folded arms, looking either down at the table or to the side. Alternatively, the patient may lie with their neck extended to look forward. These positions cause neck strain and patient motion, as well as potentially limiting the breathing space and contributing to feelings of claustrophobia in some patients. Thus, the prone position is not ergonomic and can be difficult, uncomfortable, and/or painful to hold for the length of time necessary to acquire the scan, and patient movement may cause artifacts and blurring of the image.

Placing the arms on the table to the side of the body causes the effective width of the body to be enlarged—preventing the detectors from moving to within close proximity of the torso. In NM, this causes image quality degradation as image quality decreases with increased distance between the imaged organ and the detector. Moreover, the arms, and specifically the large bones in the arms, cause signal reduction due to absorption of photons in NM, PET and CT. Additionally, the arms may cause artifacts due to the absorption of photons in NM, PET and CT.

Therefore, a need exists for a positioning apparatus to comfortably position a patient in a prone position on the patient table. Certain embodiments of the present invention are intended to meet these needs and other objectives that will become apparent from the description and drawings set forth below.

BRIEF DESCRIPTION OF THE INVENTION

In one embodiment, a patient positioning apparatus to support a patient in a prone position on a patient table during a diagnostic imaging scan comprises a head support and an arm support. The head support is configured to extend beyond an end of a patient table and to support a patient's head relative to a table top of the patient table while the patient lies on the patient table in a prone position. The arm support is joined to the head support and is configured to extend below the patient table to support a patient's forearms below the patient table.

In another embodiment, a patient positioning apparatus to support a patient in a prone position on a patient table during a diagnostic imaging scan comprises a head support extending beyond an end of a patient table. The head support supports a patient's head relative to a top surface of the patient table in one of level with the top surface and below the top surface. An arm support supports a patient's arms below a bottom surface of the patient table. At least first and second legs interconnect the head support and the arm support, and extend proximate outer edges of the patient table.

In another embodiment, a patient positioning apparatus to support a patient in a prone position on a patient table comprises a head support, an arm support, and at least first and second legs holding the head and arm supports with respect to each other. The head support extends beyond an end of a patient table for supporting a patient's head level with a top surface of a patient table. The head support comprises an opening having a beveled edge therein. The arm support supports a patient's arms below the patient table and extends substantially parallel to the patient table. The arm support comprises a tray configured to support the patient's arms beyond outer side edges of the patient table.

DETAILED DESCRIPTION OF THE INVENTION

Figure 1:
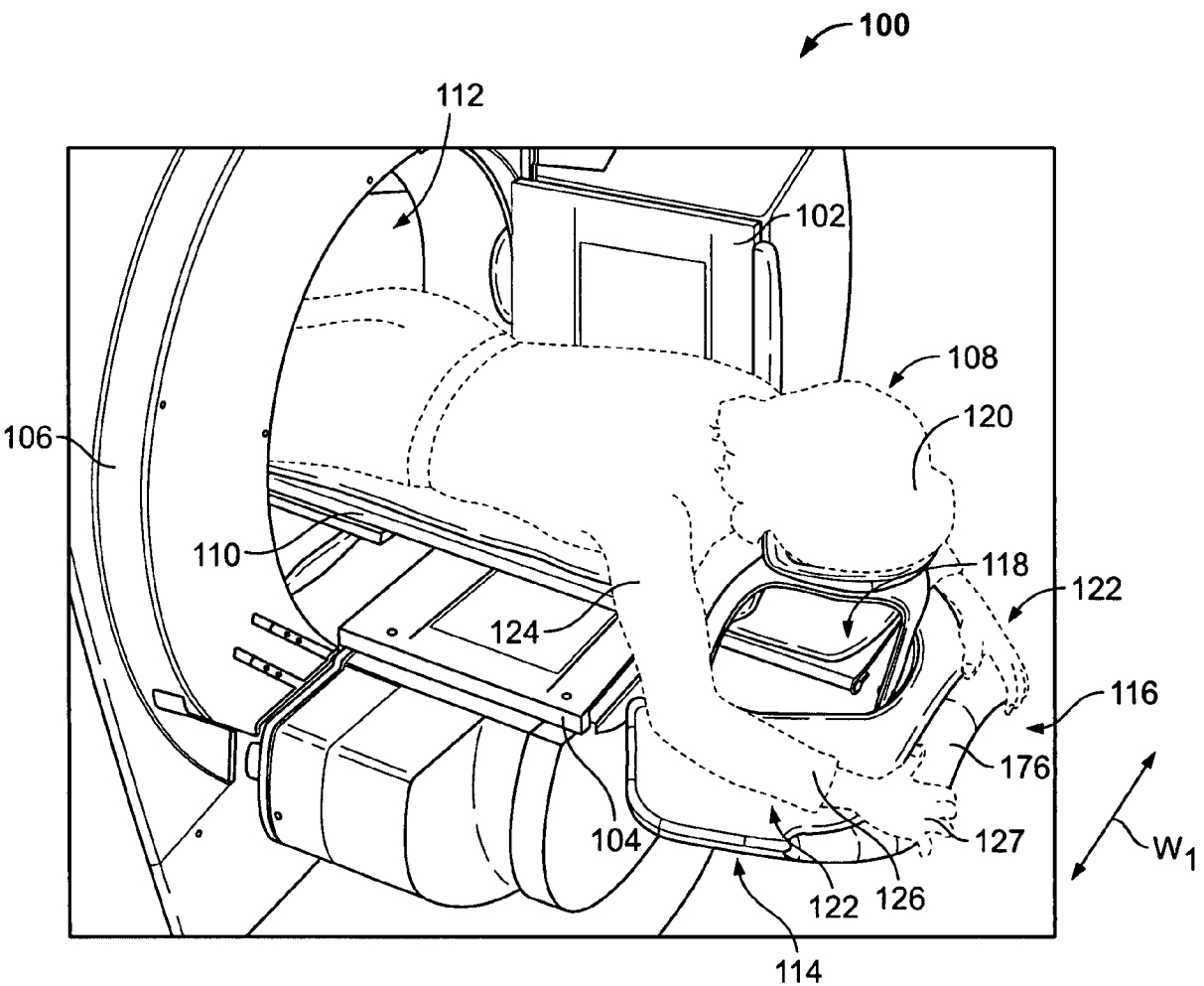
FIG. 1 illustrates an imaging system with a prone patient positioned with a positioning apparatus on a patient table in accordance with an embodiment of the present invention.

FIG. 1 illustrates an imaging system 100 with a patient 108 in a prone position on a patient table 110. Positioning apparatus 114 supports and holds the patient's head 120 and arms 122 while in the prone position. The patient 108 is facing a table top 118 of the patient table 110 with their arms 122 positioned away from their torso. In the exemplary illustration, the imaging system 100 is an NM system having first and second imaging detectors 102 and 104 mounted on a gantry 106. It should be understood that other diagnostic imaging modalities may be used, such as CT, MR and multi-modality systems. The patient table 110 extends through an opening 112 in the gantry 106 and is narrow in width W1 to allow the first and second detectors 102 and 104 to be as close to the patient 108 as possible when acquiring diagnostic data.

The prone patient positioning apparatus 114 is removably mounted to a first end 116 of the patient table 110. The positioning apparatus 114 elevates the patient's head 120 above the table top 118 of the patient table 110 to allow room between the patient's face and the table top 118 to breathe. The patient 108 maintains their neck in a straight position, that is, the neck is not extended to look forward or twisted to either side. Alternatively, the patient 108 may choose to lie with their head 120 turned to look to one side while being supported by the positioning apparatus 114 if that position affords more comfort.

The positioning apparatus 114 supports the patient's arms 122 below the patient table 110. The positioning apparatus 114 is large enough to accommodate different sizes of patients and multiple arm positions, allowing the patient 108 to find a comfortable and ergonomic position. For example, the patient's arms 122 may be positioned such that upper arm 124 is substantially perpendicular to the floor of the room or a horizontal plane of the patient table 110, while forearm 126 is placed substantially parallel to the horizontal plane of the patient table 110, with hands 127 resting on a hand rest 176.

Figure 2:
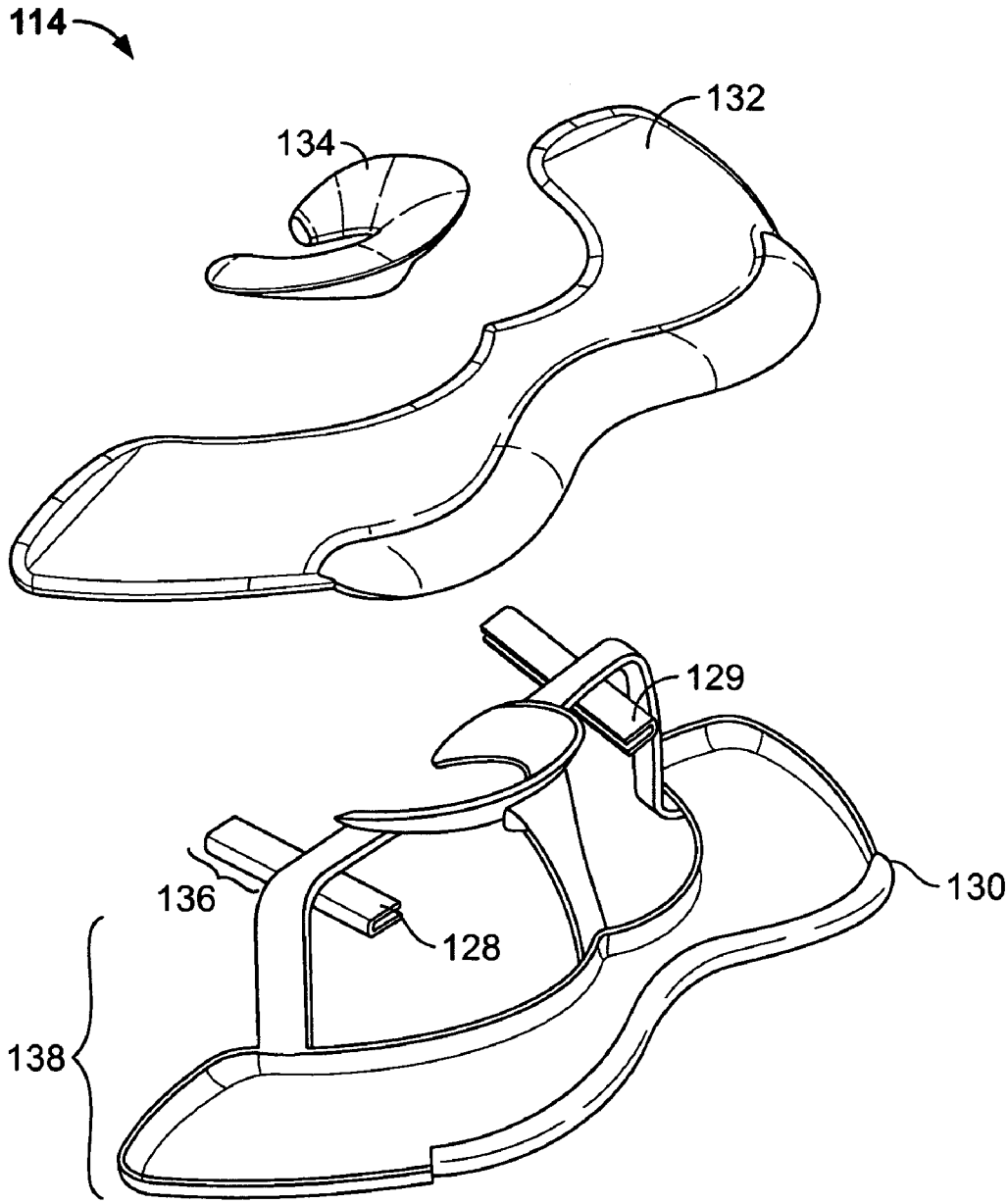
FIG. 2 illustrates an exploded view of the positioning apparatus of FIG. 1 in accordance with an embodiment of the present invention.

FIG. 2 illustrates an exploded view of the positioning apparatus 114 of FIG. 1. A support shell 130 may be formed of a hard and/or firm material such as ethelene, polyethelene, plastic, or composite material. The hard material may be chosen based on properties such as strength, durability and weight. The support shell 130 may be molded and formed as a single piece of material or may be formed of multiple pieces or portions which are joined together. The support shell 130 has integrated first and second slides 128 and 129 which slide over opposite sides of the first end 116 of the patient table 110. Therefore, the support shell 130 has an above table portion 136 above the first and second slides 128 and 129 and a below table portion 138 below the first and second slides 128 and 129. The first and second slides 128 and 129 stabilize the positioning apparatus 114 with respect to the patient table 110.

An arm cushion 132 is provided over portions of the below table portion 138. A head cushion 134 is provided over portions of the above table portion 136. The arm and head cushions 132 and 134 may be attached to the support shell 130 by adhesive, fasteners, or Velcro, for example. The arm and head cushions 132 and 134 may be formed of a soft material such as viscoelastic, foam, memory foam, or other material. The soft material may be chosen based on properties such as patient comfort, softness, support, ability to compress under pressure and conform to any shape, and the like. When weight from the patient 108 rests on the soft material, the soft material compresses and forms an indentation around the anatomy which helps to prevent movement.

A fabric cover (not shown) which may be easily removed and replaced to allow easy cleaning may be used over the soft material. Alternatively, the fabric cover may be fixed to the soft material. Optionally or alternatively, disposable coverings (not shown) which are replaced for each patient may be used over one or both of the arm and head cushions 132 and 134.

Figure 3:
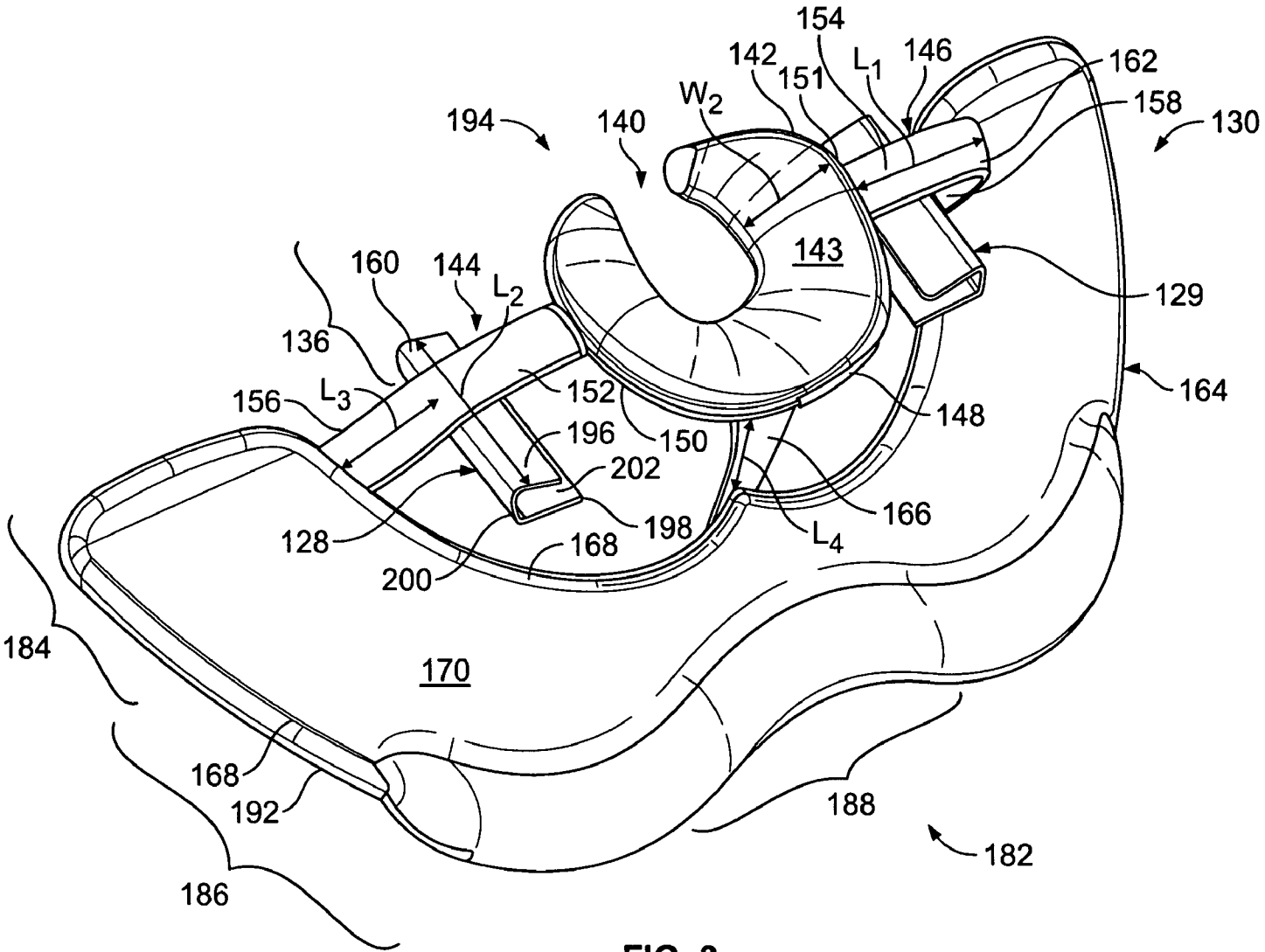
FIG. 3 illustrates the support shell of the positioning apparatus of FIG. 2 in accordance with an embodiment of the present invention.

FIG. 3 illustrates the support shell 130 of the positioning apparatus 114 of FIG. 2. The above table portion 136 has a C-shaped head support 142 with an inner opening 140. The head support 142 has a curved face support 143 with a width W2 which is slanted downwards towards the inner opening 140, providing for the curve of the patient's face resting on the head support 142. The head support 142 receives the head cushion 134 (FIG. 2), which may be held in place by adhesive, Velcro, the weight of the patient's head 120, suction cup, non-skid surface and the like.

First leg 144 has top and side portions 152 and 156 joined by bend 160. Second leg 146 has top and side portions 154 and 158 joined by bend 162. The top portions 152 and 154 extend outwardly from opposite side edges 150 and 151 of the head support 142. Length L1 of each of the top portions 152 and 154 may vary depending on the width W1 (FIG. 1) of the patient table 110. Alternatively, the length L1 of the first and second legs 144 and 146 may be adjustable to accommodate a variety of widths W1 of patient tables 110.

The first and second legs 144 and 146 bend downward at the bends 160 and 162 and the side portions 156 and 158 extend below the patient table 110 to join with arm support 164. The bends 160 and 162 may form an angle of approximately 90 degrees or greater than 90 degrees. Optionally, the bends 160 and 162 may form an angle of less than 90 degrees. Center leg 166 extends from a front edge 148 of the head support 142 to join with the arm support 164. The first and second legs 144 and 146 and center leg 166 hold the head support 142 and arm support 164 in relation to one another. Length L3 of the side portions 156 and 158 and length L4 of the center leg 166 may be fixed. Alternatively, the lengths L3 and L4 may be adjustable to change the relation of the head and arm supports 142 and 164 with respect to each other; that is, to separate the head and arm supports 142 and 164 by greater or lesser distances. Open areas between the head support 142 and the arm support 164, as well as between the first and second legs 144 and 146 and center leg 166, allow room for the patient 108 to breathe as well as receive light from the surrounding area.

The arm support 164 may be curved or form a W shape which extends proximate each side of the first end 116 of the patient table 110. A lip 168 is formed around portions of outer edge 192 to create a shallow tray 170 within the lip 168 which has waves or curves. In other words, the contour of the top of the shallow tray 170 may not be flat. Proximate a rear end 194 of the support shell 130, a rear portion 184 of opposite sides of the tray 170 may tilt or curve upwards towards the patient table 110. Moving towards a front end 182 of the support shell 130, an intermediate portion 186 of the tray 170 may curve downwards away from the patient table 110, and in a center portion 188 the tray 170 may again extend upwards towards the patient table 110.

The first and second slides 128 and 129 are mounted to the first and second legs 144 and 146. Alternatively, the first and second slides 128 and 129 may be formed integral with the side portions 156 and 158. The first and second slides 128 and 129 have a top portion 196, bottom portion 198 and side portion 200 which form an opening 202 there-between. The first and second slides 128 and 129 have a length L2, which may be based on a degree of stability desired or required. The positioning apparatus 114 is slid onto the first end 116 of the patient table 110 so that side edges of the patient table 110 are held in the openings 202, while the top portions 196 of the first and second slides 128 and 129 are in contact with the table top 118. The bottom portions 198 may be in contact with a bottom surface of the patient table 110 or may be separated by a small distance. Optionally, the first and second slides 128 and 129 may be movable and/or adjustable along the side portions 156 and 158 to provide for patient tables 110 of different widths W1. Alternatively, the first and second slides 128 and 129 may be formed without one or both of the bottom portions 198 and side portions 200. Alternatively, the positioning apparatus 114 may be secured to the patient table 110 with a clamp or other fastener, or may be stabilized and held above the table top 118 by legs which are configured to contact and provide resistance against the table top 118.

Figure 4:
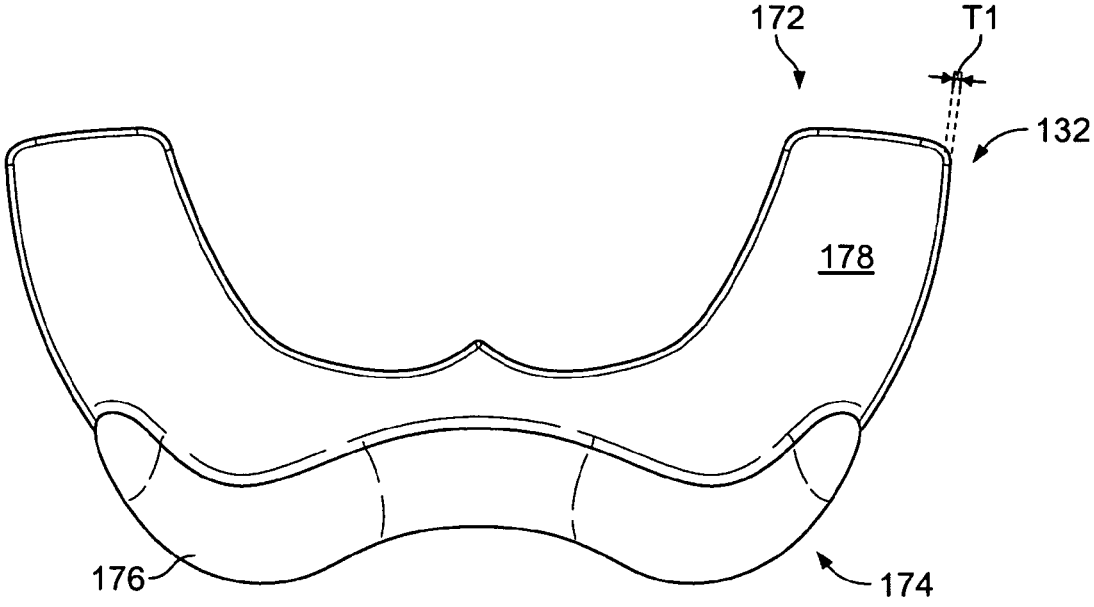
FIG. 4 illustrates the arm cushion of FIG. 2 which is placed on the arm support of the support shell in accordance with an embodiment of the present invention.

FIG. 4 illustrates the arm cushion 132 of FIG. 2 which is placed within the tray 170 of the arm support 164 of the support shell 130. The arm cushion 132 may be attached and/or fastened to the arm support 164 as discussed previously with regard to the head cushion 134. The arm cushion 132 has a rear edge 172 and a front edge 174. An elbow and forearm support 178 extends from the rear edge 172 towards the front edge 174 with a thickness T1 which may be uniform throughout. A hand rest 176 protrudes upward towards the patient table 110 from the elbow and forearm support 178 to provide a "gripping area" for the patient 108. Optionally, the thickness T1 may be varied or arm cushions 132 having different uniform thicknesses T1 may be provided. For example, an arm cushion 132 with a larger thickness T1 may be desirable for a smaller patient 108 who has relatively shorter upper arms 124, while an arm cushion 132 with a smaller thickness T1 may be desirable for a larger patient 108 who has relatively longer upper arms 124.

Figure 5:
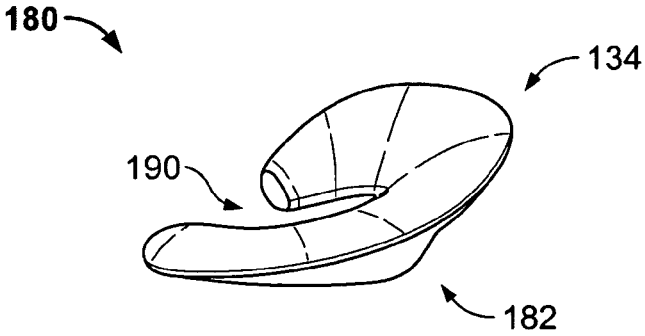
FIG. 5 illustrates the substantially C-shaped head cushion of FIG. 2 which is placed on the head support of the support shell in accordance with an embodiment of the present invention.

FIG. 5 illustrates the substantially C-shaped head cushion 134 of FIG. 2 which is placed on the head support 142 of the support shell 130. The head cushion 134 is contoured to provide cushioned support to the forehead and sides of the patient's head 120. The weight of the head 120 is distributed and equally supported along the head cushion 134. An opening 190, corresponding with the opening 140 of the head support 142 (FIG. 3), allows room for the patient 108 to breathe.

Figure 6:
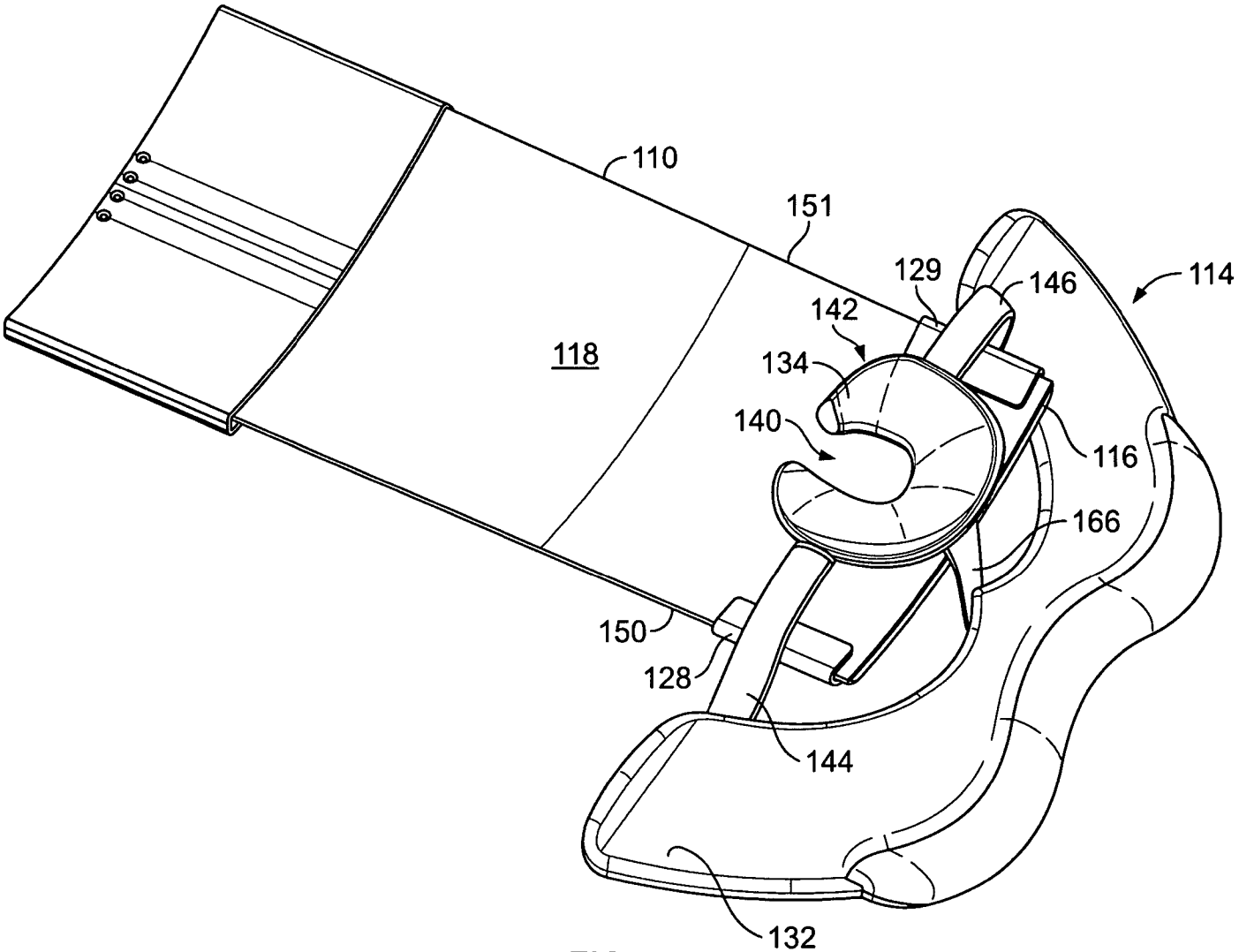
FIG. 6 illustrates the prone patient positioning apparatus mounted on the patient table in accordance with an embodiment of the present invention.

FIG. 6 illustrates the prone patient positioning apparatus 114 mounted on the patient table 110. The first and second slides 128 and 129 slide over the opposite side edges 150 and 151 of the patient table 110 proximate the first end 116. The positioning apparatus 114 may be pushed onto the patient table 110 until the first and second slides 128 and 129 are fully on the patient table 110 and/or when the center leg 166 contacts the first end 116. The first and second slides 128 and 129 are located on the first and second legs 144 and 146 such that the head support 142 is elevated above the table top 118, allowing room for the patient 108 to breathe. Alternatively, the first and second slides 128 and 129 may be removed and blocks of material such as wood, metal or plastic may be positioned between the top portions 152 and 154 and the table top 118. The blocks of material may be formed of different thicknesses to elevate the head support 142 greater or lesser distances above the table top 118.

The following discussion refers also to FIG. 1. The patient 108 lies on the patient table 110 in a prone position, placing the patient's face on the head cushion 134. The patient's nose and mouth are positioned within the opening 140 and the patient 108 can breathe normally as well as see light from the surrounding area.

The patient's torso and legs are supported by the patient table 110 while the patient's arms 122 are allowed to drop down below the patient table 110, which is a comfortable, forward position with respect to the shoulders, neck and back of the patient 108. The patient 108 rests their forearms 126 on the arm cushion 132 and their hands 127 on the hand rest 176. The hand rest 176 protrudes upward and is curved to support and allow a natural ergonomic curve of the patient's hands 127 and fingers. The arm cushion 132 extends beyond the side edges 150 and 151 of the patient table 110 to accommodate various sized patients 108. The hand rest 176 extends along the front end 182 of the positioning apparatus 114. Therefore, the patient 108 may adjust the position of their body to be customized and comfortable, minimizing the stress and strain placed on their neck, back and shoulders.

The soft material of the arm cushion 132 and head cushion 134 comfortably support the patient's head 120, forearms 126 and hands 127. The arm and head cushions 132 and 134 compress in areas that receive weight, creating indentations representative of the patient's anatomy. Therefore, the arm and head cushions 132 and 134 mold and contour to the individual curves and shape of the patient's head 120, forearms 126 and hands 127. The patient 108 is thus held and stabilized by the arm and head cushions 132 and 134 within the indentations to help prevent movement during the scan.

Figure 7:
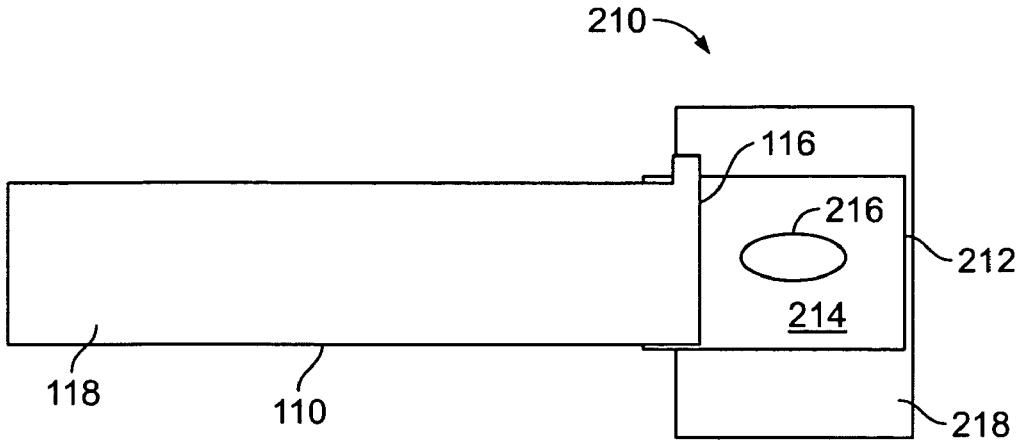
FIG. 7 illustrates a top view of a positioning apparatus configured to position a patient's face level with or below the table top in accordance with an embodiment of the present invention.

FIG. 7 illustrates a top view of a positioning apparatus 210 configured to position a patient's face approximately level with or below the table top 118. The positioning apparatus 210 has a head support 212 extending beyond the first end 116 of the patient table 110. The head support 212 has a top surface 214 which may be level with or slightly below a plane extending from the table top 118. Optionally, the head support 212 and/or positioning apparatus 210 may be configured to position the top surface 214 slightly above the plane extending from the table top 118. By extending the head support 212 beyond the first end 116, the position of the head 120 of the patient 108 may be adjusted relative to the table top 118, while still providing adequate breathing space.

The head support 212 may span the width of the patient table 110, or may be more narrow than the patient table 110. The head support 212 may be formed of one or more sheets of square or rectangular material to facilitate interconnection with the patient table 110, or may be formed similar to the head support 142 (FIG. 3) and interconnected to the patient table 110 using one or more legs, clamps, or other fasteners.

An opening 216 is formed within the head support 212 to provide breathing space and light for the patient 108. The patient 108 may lie prone on the patient table 110, positioning their face in the opening 216. The head cushion 134 (FIG. 5) may optionally be placed proximate the opening 216 for patient comfort. The head cushion 134 may be formed of different thicknesses to allow the position of the patient's head 120 to be further adjusted with respect to the table top 118. Optionally, a head cushion (not shown) may be removably attached to the head support 212, and may be formed similar to the head cushion 134 in a C-shape, or may be formed as an enclosed, elongated circle, following the perimeter of the opening 216.

Arm support 218 extends below the patient table 110 and beyond the first end 116. The arm support 218 may be a flat surface as illustrated, or may be the support shell 130 and arm cushion 132 as previously discussed.

The head support 212 and arm support 218 may be formed integral with one another or may be formed separately and joined by fasteners. For example, the positioning apparatus 210 may utilize some of the same interconnections as the positioning apparatus 114 (FIG. 1). For example, the head support 212 and arm support 218 may be joined by one or more legs similar to the first and second legs 144 and 146.

Figure 8:
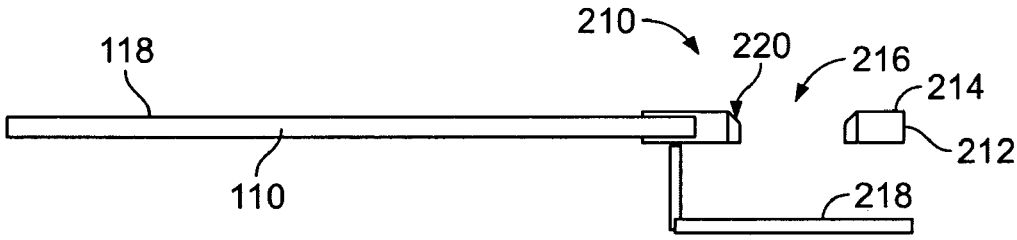
FIG. 8 illustrates a cross-sectional view of the positioning apparatus of FIG. 7 showing the relative position of the positioning apparatus and the table top in accordance with an embodiment of the present invention.

FIG. 8 illustrates a cross-sectional view of the positioning apparatus 210 of FIG. 7 showing the relative position of the positioning apparatus 210 and the table top 118. The top surface 214 of the positioning apparatus 210 may be slightly above the surface of the table top 118, which may be dependent at least in part upon how the positioning apparatus 210 and table 110 are interconnected. The opening 216 may be formed with a graduated or beveled edge 220 along the perimeter, allowing the patient's head 120, and optionally the head cushion 134, to support the patient's head 120 and/or face at a position lower than the table top 118.

Figure 9:
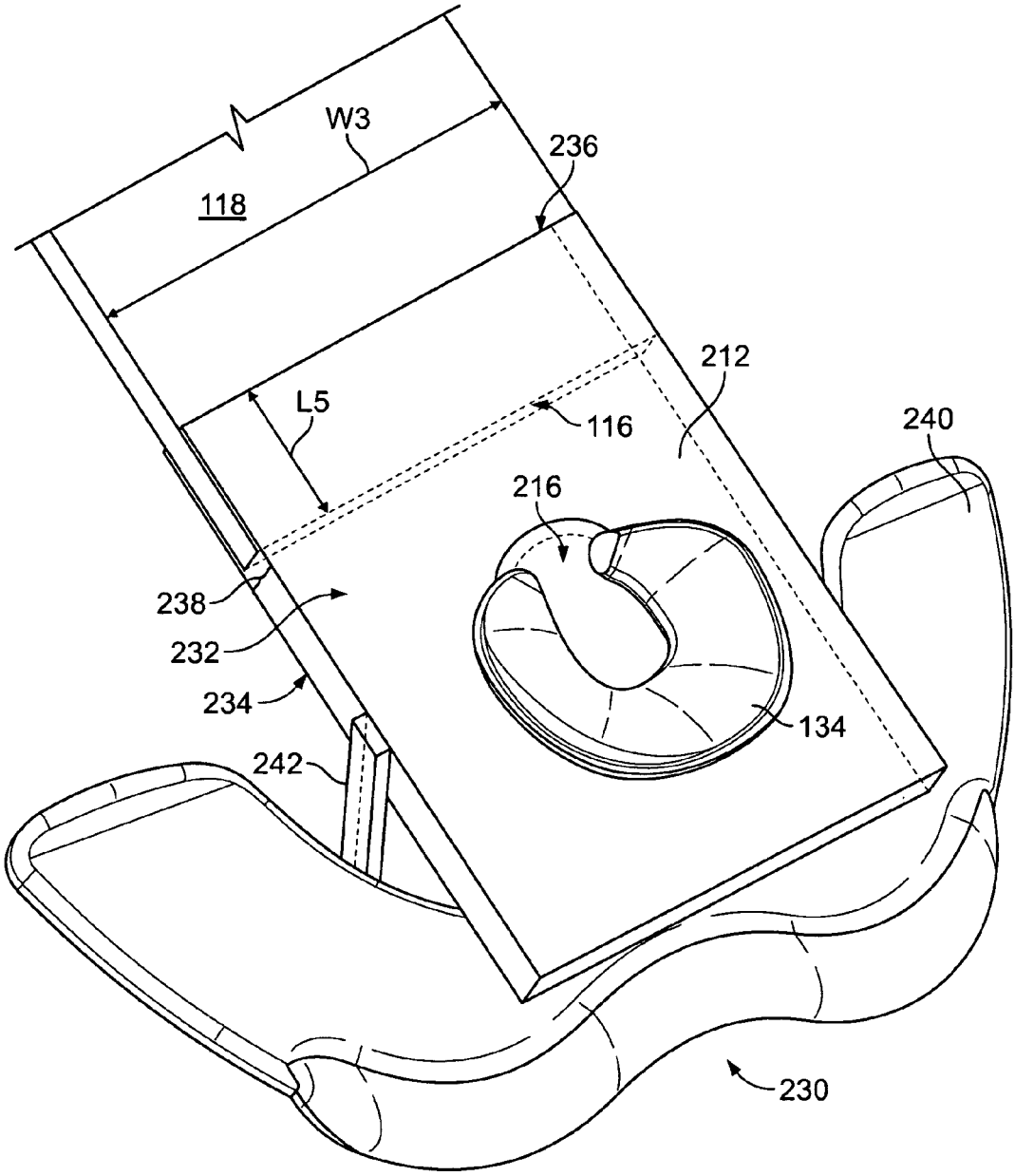
FIG. 9 illustrates an alternative positioning apparatus for positioning the head of the patient level with or below the table top in accordance with an embodiment of the present invention

FIG. 9 illustrates an alternative positioning apparatus 230 for positioning the head 120 of the patient 108 level with or below the table top 118. The head support 212 (FIG. 7) may be configured of top and bottom pieces of material 232 and 234 which are substantially parallel to one another. The head support 212 is illustrated with the head cushion 134 (FIG. 5) which may be placed within the opening 216 for patient comfort. The head support 212 may be joined to patient arm support 240, which may be formed similar to the below table portion 138 (FIG. 2) of the support shell 130. The arm cushion 132 (FIG. 4) may be provided over portions of the arm support 240. Connection arm 242 (along with one or more additional connection arms (not shown)), may be used to join the head support 212 and the patient arm support 240.

The head support 212 has a table end 236, and the top and bottom pieces of material 232 and 234 form a table receiving portion 238 there-between along the table end 236. The first end 116 of the patient table 110 is inserted into the table receiving portion 238. A stopping mechanism (not shown) may be formed between the top and bottom pieces of material 232 and 234 to allow a predetermined length L5 of the patient table 110 to be inserted into the table receiving portion 238. The table receiving portion 238 may extend continuously along width W3 of the patient table 110. The top and bottom pieces of material 232 and 235 may be of flexible and/or semi-rigid material, allowing an amount of bending, flex and/or movement to facilitate interconnection with a table 110 which is not flat, but may instead be concave, while remaining strong and holding the patient 108 in position during a scan. Alternatively, the top and bottom pieces of material 232 and 234 may be rigidly formed to accommodate a flat or a curved table, or both a flat and a curved table.

Optionally, a hinge (not shown) may be formed within the head support 212, between the opening 216 and the table end 236, allowing the angle of the head support 212 to be changed relative to the plane of the table top 118. Optionally, other adjustment mechanism, such as a drive screw, locking pin and adjustment hole combinations, and the like may be provided for securing the head support 212 at other desired positions relative to the table top 118.

Figure 10:
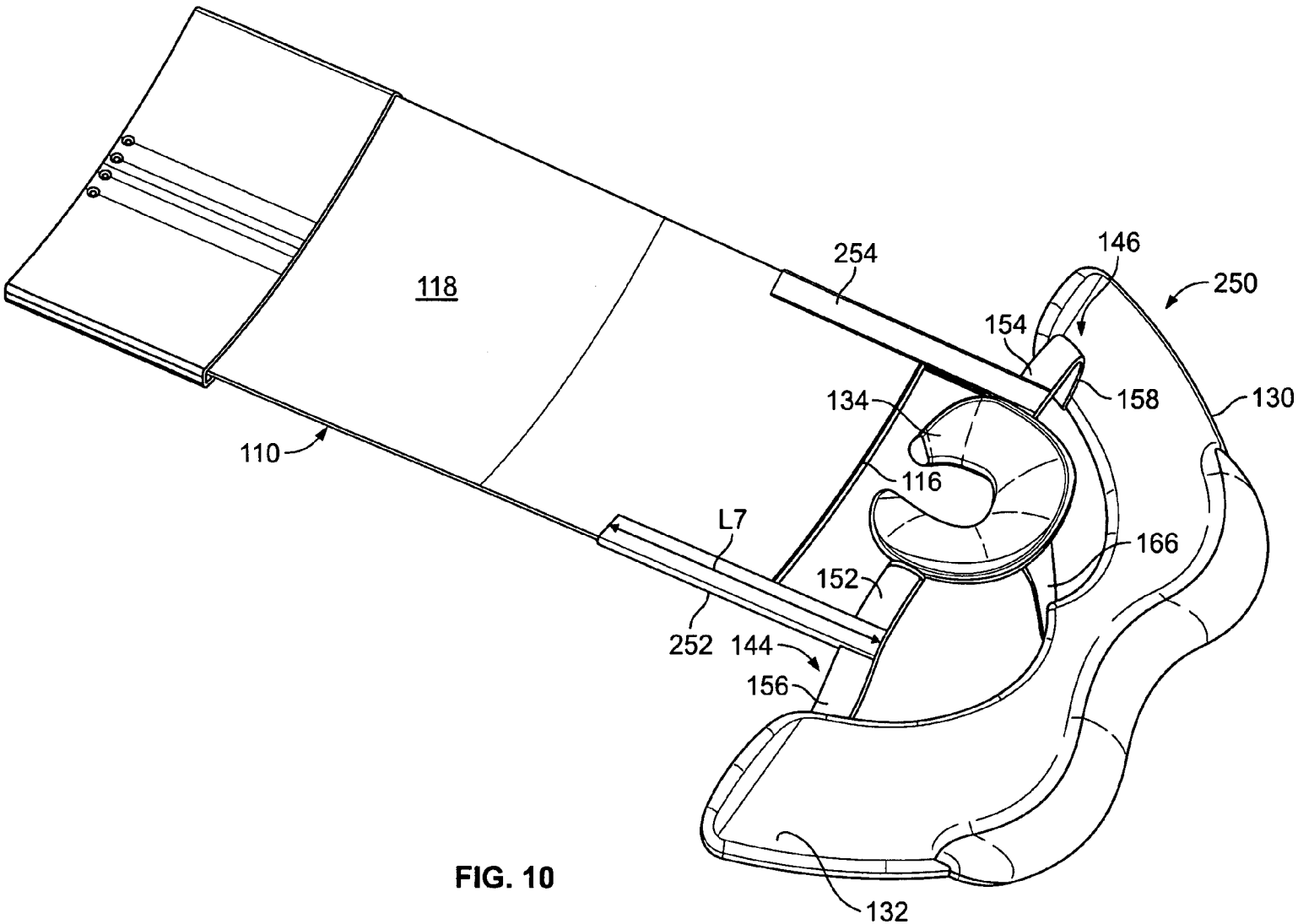
FIG. 10 illustrates a positioning apparatus used to position the patient's head approximately level with the table top in accordance with an embodiment of the present invention

FIG. 10 illustrates a positioning apparatus 250 used to position the patient's head 120 approximately level with the table top 118. The positioning apparatus 250 may utilize the support shell 130 (FIG. 2), and the arm and head cushions 132 and 134. As previously discussed in FIG. 3, the first, second and center legs 144, 146 and 166 extend between the arm and head cushions 132 and 134. The first and second legs 144 and 146 have the top portions 152 and 154, respectively, and the side portions 156 and 158, respectively.

First and second slides 252 and 254 are interconnected with the top portions 152 and 154 of the first and second legs 144 and 146, respectively, which lowers the level of the head cushion 134 with respect to the table top 118 in comparison with the positioning apparatus 114 of FIG. 1. By way of example, the first and second slides 252 and 254 may be formed integral with the top portions 152 and 154, bolted together, interconnected with a bonding agent, form interlocking pieces, and the like. The first and second slides 252 and 254 may be longer than the first and second slides 128 and 129 (FIG. 3), allowing the positioning apparatus 250 to extend beyond the first end 116 of the patient table 110. The first and second slides 252 and 254 may have a length L7 which may be based on a degree of stability desired or required.

Figure 11:
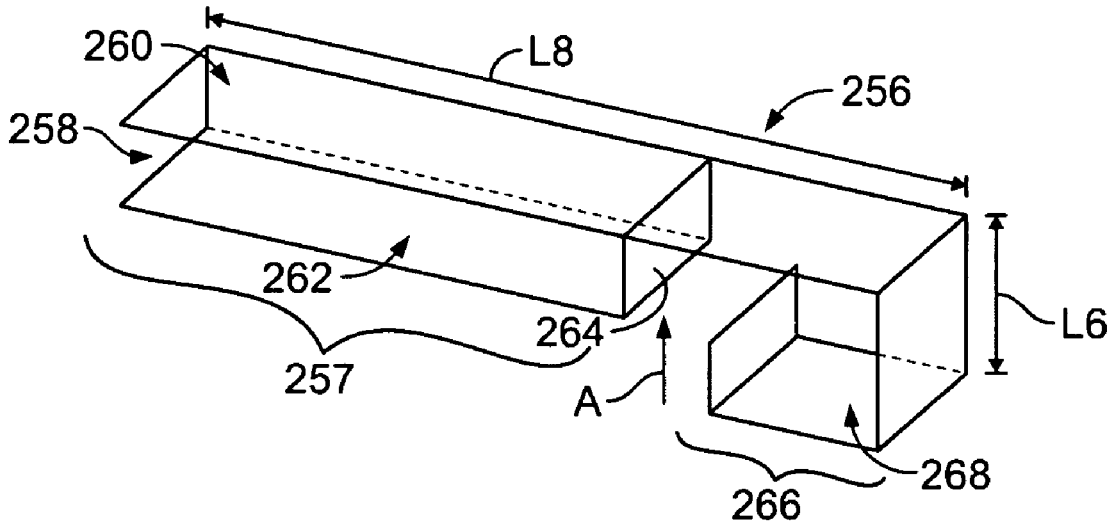
FIG. 11 illustrates an alternative configuration for interconnecting the table and the support shell (FIG. 10) in accordance with an embodiment of the present invention The foregoing summary, as well as the following detailed description of certain embodiments of the present invention, will be better understood when read in conjunction with the appended drawings. It should be understood that the present invention is not limited to the arrangements and instrumentality shown in the attached drawings.

FIG. 11 illustrates an alternative configuration for interconnecting the patient table 110 and the support shell 130 (FIG. 10). Slide 256 may correspond to the second slide 254 (FIG. 10), and thus a mirror configuration may be formed to correspond to the first slide 252. The slide 256 has a slide portion 257 and a hook portion 266. Open slide portion 258 accepts the first end 116 of the patient table 110. Upper portion 260 is configured to rest on the table top 118 and lower portion 262 is configured to be below the patient table 110 and/or contact the lower surface of the patient table 110. The upper portion 260 extends a length L8 of the slide 256, while the lower portion 262 may extend a portion of the length L8. A stop plate 264 may be formed at an end of the lower portion 262 to interface with the first end 116 of the patient table 110 when the patient table 110 is fully inserted into the slide 256. The length of the lower portion 262 and the placement of the stop plate 264 may be changed based on stability requirements, and the like.

The hook portion 266 extends beyond the slide portion 257, and downward a length L6 which may be adjusted to extend different distances from the upper portion 260. The hook portion 266 is bent and formed to create an arm supporting cavity 268. Optionally, the slide 256 may be mounted to the patient table 110 prior to interconnecting the slide 256 with the support shell 130. The support shell 130 may then be positioned below the slide 256, lifting the second leg 146 in the direction of arrow A between the slide and hook portions 257 and 266, and into the arm supporting cavity 268. A longer length L6 will result in positioning the patient's head 120 at a lower position relative to the table top 118. Optionally, blocks or other material (not shown) may be used within the arm supporting cavity 268 to raise and/or adjust the position of the patient's head 120 relative to the table top 118. Alternatively, the slide 256 (and corresponding left hand slide) may be formed integral with the support shell 130. Also, it should be understood that other support interconnections and mechanisms may be used to interconnect the slide 256 and the support shell 130.

While the invention has been described in terms of various specific embodiments, those skilled in the art will recognize that the invention can be practiced with modification within the spirit and scope of the claims.

What is claimed is:

1. A patient positioning apparatus to support a patient in a prone position on a patient table during a diagnostic imaging scan, the apparatus comprising:

a head support configured to extend beyond an end of the patient table, the head support supporting a patient's head relative to a table top of the patient table while the patient lies on the table top in a prone position, the head support including first and second sheets of material extending parallel to one another and forming a table receiving portion in space therebetween, the table receiving portion configured to receive the end of the patient table so that the first sheet of material extends over the table top; and an arm support joined to the head support, the arm support configured to extend below the patient table to support a patient's forearms below the patient table.

2. The patient positioning apparatus of claim 1, wherein the first and second sheets of material are semi-rigid to enable at least one of flexing and bending, the first and second sheets of material being configured to at least one of flex and bend to couple to different patient tables having different contours.

3. The patient positioning apparatus of claim 1, wherein the table top extends along a plane and the head support has an opening in a center thereof, the opening having a beveled edge configured to support the patient's head at a position being one of even with and below the plane of the table top.

4. The patient positioning apparatus of claim 1, further comprising a head cushion covering a top surface of the head support, the head cushion being formed of a material having at least one of compression and memory properties, the head cushion forming an indentation which conforms to the patient's head.

5. The patient positioning apparatus of claim 1, further comprising an arm cushion covering a top surface of the arm support, the arm cushion being formed of a material having at least one of compression and memory properties, the arm cushion forming an indentation which conforms to a shape of the patient's forearms.

6. The patient positioning apparatus of claim 1, further comprising head and arm cushions being removably attached to the head support and arm support, respectively.

7. The patient positioning apparatus of claim 1, wherein the arm support is formed of at least one sheet of material, the arm support extending approximately parallel to the table top.

8. The patient positioning apparatus of claim 1, wherein the patient table has top and bottom surfaces and a thickness extending therebetween, the first and second sheets of material slidably engaging the top and bottom surfaces, respectively, when the end of the patient table is received within the table receiving portion.

9. The patient positioning apparatus of claim 1, wherein the head support is removably mounted to the patient table, the head support sliding in an axial direction along the patient table when the head support is one of removed from and mounted to the patient table.

10. The patient positioning apparatus of claim 1, wherein the table top has a length and a width, the length configured for a height of the patient, the first sheet of material extending along the width and a top surface of the patient table.

11. The patient positioning apparatus of claim 1, wherein the table top extends to the end of the patient table, the first sheet of material of the head support extending over the table top and beyond the end of the patient table, the table top and the first sheet of material collectively forming a substantially continuous surface that extends beyond the end of the patient table thereby lengthening the patient table.

12. A patient positioning apparatus to support a patient in a prone position on a top surface of a patient table during a diagnostic imaging scan, the apparatus comprising:

a head support removably mounted to the top surface at an end of the patient table, the head support extending beyond the end of the patient table and supporting a patient's head relative to the top surface of the patient table, the head support having a sheet of material that rests on the top surface and extends at least to the end of the patient table when removably mounted thereto and while supporting the patient's head, wherein the sheet of material slides in an axial direction along the patient table when the head support is removably mounted; and an arm support joined to the head support, the arm support supporting a patient's arms below a bottom surface of the patient table.

13. The patient positioning apparatus of claim 12, wherein the sheet of material is a first sheet of material and the head support further comprises a second sheet of material positioned parallel to the first sheet of material, the first and second sheets of material forming a table receiving portion in space therebetween for receiving the end of the patient table to removably mount the head support to the patient table.

14. The patient positioning apparatus of claim 13, wherein the first and second sheets of material are formed to accommodate at least one of a flat patient table and a curved patient table.

15. The patient positioning apparatus of claim 12, wherein the top surface of the patient table extends to the end of the patient table, the top surface and the sheet of material collectively forming a substantially continuous surface that extends beyond the end of the patient table.

16. A patient positioning apparatus to support a patient in a prone position on a patient table, the patient table having a top surface that extends to an end of the patient table, the apparatus comprising:

a head support configured to be mounted to the end of the patient table to support a head of the patient, the head support having a sheet of material that is substantially level with the table top, the sheet of material having a top surface that extends beyond the end of the patient table, the top surfaces of the patient table and the sheet of material collectively forming a substantially continuous surface to support the patient thereon, wherein the sheet of material is configured to slidably engage a length of the patient table when mounted thereto; and an arm support joined to the head support, the arm support configured to support forearms of a patient below the table top.

17. The patient positioning apparatus of claim 16, wherein the patient table has a width extending between outer edges, the arm support including a tray that extends widthwise under the head support between the outer edges, the tray extending laterally beyond each outer edge.

18. The patient positioning apparatus of claim 16, wherein the sheet of material is a first sheet of material and the head support further comprises a second sheet of material that extends parallel to the first sheet of material, the first and second sheets of material having a table receiving portion in space therebetween that is configured to receive the end of the patient table to mount the head support thereto.

* * * * *